US006568507B2

(12) United States Patent
Chandler

(10) Patent No.: US 6,568,507 B2
(45) Date of Patent: May 27, 2003

(54) GAS AND OIL SUCTION SYSTEM AND METHOD

(75) Inventor: Kevin R. Chandler, Burl, NC (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,021

(22) Filed: Jul. 25, 2001

(65) Prior Publication Data

US 2003/0019690 A1 Jan. 30, 2003

(51) Int. Cl.[7] ..... F16C 3/14; F16N 33/00
(52) U.S. Cl. ..... 184/1.5; 123/196 R
(58) Field of Search ..... 184/1.5, 6, 6.5; 123/196 R, 196 A, 196 S; 141/83

(56) References Cited

U.S. PATENT DOCUMENTS 4,095,672 A 6/1978 Senese
4,976,235 A 12/1990 Commanday
5,772,402 A 6/1998 Goodman
5,964,256 A * 10/1999 Bedi et al. ..... 141/83
6,036,446 A * 3/2000 Goodman ..... 417/54
6,092,390 A * 7/2000 Griffith, Jr. ..... 62/468
6,098,752 A * 8/2000 McCaleb ..... 184/1.5

* cited by examiner

*Primary Examiner*—David Fenstermacher
(74) *Attorney, Agent, or Firm*—Rankin, Hill, Porter & Clark LLP; Alan T. McDonald; Vincent Ciamacco

(57) ABSTRACT

A system and method for removing liquids from engines, the system including first and second liquid storage tanks that are disposed for serial flow therebetween, a pressure source, and a vacuum source. The first liquid storage tank is continuously connected to the vacuum source, while the second liquid storage tank is alternatively connected to either the vacuum source, during filling, or the pressure source, during draining. Opening and closing the valves is controlled in response to sensed liquid levels in the tanks.

19 Claims, 4 Drawing Sheets

GAS AND OIL SUCTION SYSTEM AND METHOD

BACKGROUND OF THE INVENTION

1. Field of the Invention

The present invention relates to a method and system for removing oil and gasoline from an engine.

2. Description of Related Art

It is common for small four stroke engines used in outdoor power equipment, such as lawn mowers, edgers, chippers, generators, and power washers, to be manufactured in dedicated factories that are remote from the final assembly plant. The completed engines are then periodically shipped to the final assembly plant.

Manufacturers of power equipment often require that the engines be started prior to shipment. This helps insure that the engines will work when they are ultimately assembled into the power equipment. Therefore, the engine manufacturer must include means for starting the engines prior to shipment, which entails filling the engine crankcase with oil and at least partially filling the fuel tank with gasoline.

Thereafter, in order to prevent spills and leaks, the engines must be drained of gasoline and oil before being packaged for shipment. Due to the viscosity of oil and the speed at which the engines must be drained, it has heretofore proven necessary to use a pump to evacuate oil and gasoline from the engines. The pumped-out oil and gasoline is directed toward an oil recovery tank and a gas recovery tank, respectively, for recycling and/or re-use.

In the past, oil and gas have been pumped out of the engine by pumps that are in the flow line between the crankcase and the oil recovery tank, in the case of oil, or in the flow line between the fuel tank and the gas recovery tank, in the case of gasoline. However, this prior art method and system has proven unreliable as the pumps have required relatively frequent maintenance and repair. It is believed that oil and gasoline damage the pump seals, resulting in leakage problems, frequent repair, and excessive downtime.

Therefore, there exists a need in the art for a method and system for quickly and reliably removing oil and gasoline from an engine.

SUMMARY OF THE INVENTION

The present invention is directed toward an improved method and system for removing oil and gasoline from an engine.

In accordance with the present invention, a system for removing liquid from an engine includes a first liquid storage tank, a second liquid storage tank, a return tank, a vacuum source, and a pressurized air source. Fluid communication between the tanks and the pressure and vacuum sources is controlled by a controller that actuates valves in response to sensed liquid levels in the first and second liquid storage tanks.

In further accordance with the present invention, a first conduit, which is adapted for insertion into an engine reservoir that contains liquid to be removed, provides liquid to the first liquid storage tank. A second conduit extends between and fluidly interconnects the first and second liquid storage tanks. A first control valve is disposed in the second conduit and serves to control fluid communication therethrough.

In further accordance with the present invention, the vacuum source establishes a vacuum or sub-atmospheric pressure in the first and second liquid storage tanks while the pressurized air source selectively communicates pressurized or over-atmospheric pressure air to the second liquid storage tank. Preferably, vacuum is continuously provided to the first liquid storage tank while pressurized air and vacuum are supplied to the second liquid storage tank in a mutually exclusive fashion.

In accordance with other aspects of the invention, sensors are provided for sensing liquid levels in the first and second liquid storage tanks. Also, a controller actuates the first and second valves and controls communication of pressurized air from said pressure source, in response to sensed liquid levels.

The present invention also teaches a method for removing liquids from an engine reservoir. The method includes communicating vacuum to the first and second liquid storage tanks and inserting a nozzle of a first conduit into the engine reservoir. The first conduit includes a nozzle valve for controlling communication of liquid from the engine reservoir to the first liquid storage tank via the first conduit.

In further accordance with the method, a first control valve is placed in a first position to permit liquid to flow from the first liquid storage tank to the second liquid storage tank. The level of liquid in the first and second liquid storage tanks is monitored.

In further accordance with the inventive method, when the liquid level in the second liquid storage tank reaches a first predetermined level, the first control valve is placed in a second position to prevent liquid flow from the first liquid storage tank to the second liquid storage tank, communication of vacuum sub-atmospheric pressure air to the second liquid storage tank is discontinued, and pressurized or over-atmospheric pressure air is communicated to the second liquid storage tank to force liquid therein to flow through the third conduit toward the return tank.

In accordance with another aspect of the method, when the liquid level in one of the first and second liquid storage tanks reaches a second predetermined level, the communication of over-atmospheric pressure air to the second liquid storage tank is discontinued, communication of sub-atmospheric pressure air to the second liquid storage tank is reestablished, and the first control valve is returned to the first position to permit liquid to flow from the first liquid storage tank to the second liquid storage tank.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
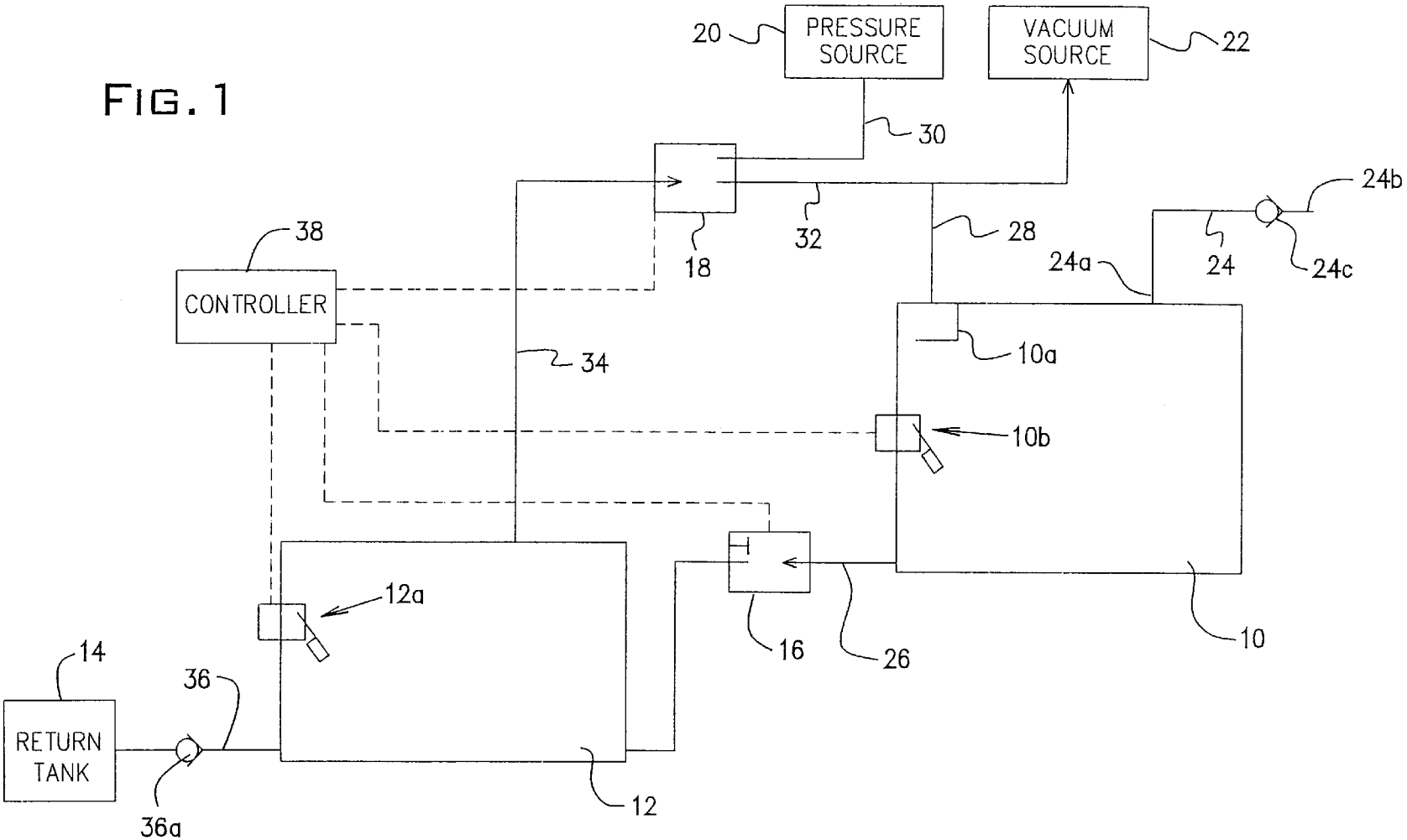
FIG. 1 is a schematic diagram of a system according to a first preferred embodiment of the present invention.

With reference to FIG. 1, a first preferred embodiment of a system according to the present invention is illustrated. The system includes a first liquid storage tank 10, a second liquid storage tank 12, a return tank 14, a first control valve 16, a second control valve 18, a pressure source 20, a vacuum source 22, and a series of conduits 24, 26, 28, 30, 32, 34.

The first liquid storage tank 10 is connected to an outlet 24*a* of a first conduit 24, which serves as a liquid inlet and includes an inlet nozzle 24*b* having a manually-operated inlet nozzle valve (not shown). The first conduit 24 has a check valve 24*c* disposed therein to prevent reverse flow therethrough. The inlet nozzle 24*b* is designed for insertion into an engine reservoir, such as a crankcase or fuel tank, and the nozzle valve is opened and closed by a user to permit communication of suction to the inlet nozzle 24*b* and thereby withdraw liquids from the engine reservoir. Liquids flowing through the inlet conduit 24 are delivered to the first liquid storage tank 10.

The first liquid storage tank 10 is fluidly connected to the second liquid storage tank 12 via a second conduit 26 and is connected to the vacuum source 22 via a first vacuum conduit 28. Preferably, the second conduit 26 is connected, at opposite ends, to bottom ends of the first and second liquid storage tanks 10, 12, respectively. The second conduit 26 has the first control valve 16 disposed therein to control liquid flow through the second conduit 26 from the first liquid storage tank 10 toward the second storage tank 12. The first control valve 16 is movable between a first position establishing fluid communication between the first and second liquid storage tanks 10, 12 and a second position blocking fluid communication between the storage tanks 10, 12.

The first vacuum conduit 28 is connected to a top of the first liquid storage tank 10. A flow director or shield 10*a* is preferably provided within the first liquid storage tank 10 to prevent liquid from being drawn through the first vacuum conduit 28. A first float-type switch 10*b* is secured to the first liquid storage tank 10 at a predetermined location between the top and bottom ends thereof. Naturally, it is considered apparent that means other than the first float-type switch 10*b* disclosed herein may be used with equal functionality without departing from the scope and spirit of the present invention.

The second liquid storage tank 12 is disposed vertically below the first liquid storage tank 10 and receives liquids from the first liquid storage tank 10 by means of the second conduit 26 and the first control valve 16. The second liquid storage tank 12 is also connected to the return tank 14 by means of an outlet conduit 36. Preferably, a check valve 36*a* is disposed in the outlet conduit 36, as illustrated, to prevent reverse flow of liquid in the outlet conduit 36.

The second liquid storage tank 12 is also connected to the vacuum source 22 and to the pressure source 20 by means of the second control valve 18, a second vacuum conduit 32, a first pressure conduit 30, and a common conduit 34. More specifically, and as illustrated in FIG. 1, the second vacuum conduit 32 and first pressure conduit 30 connect the vacuum and pressure sources 22, 20, respectively, to inlets of the second control valve 18, while the common conduit 34 extends from an outlet of the second control valve 18 to the second liquid storage tank 12. The second control valve 18 is selectively movable between a first position establishing communication between the vacuum source 18 and the second liquid storage tank 12 and a second position establishing communication between the pressure source 20 and the second liquid storage tank 12.

A second float-type switch 12*a* is secured to the second liquid storage tank 12 at a vertical location that is relatively between the top and bottom ends of the tank 12. As noted hereinbefore, it is considered apparent that means other than the second float-type switch 12*a* disclosed herein may be used with equal functionality without departing from the scope and spirit of the present invention.

Figure 3:
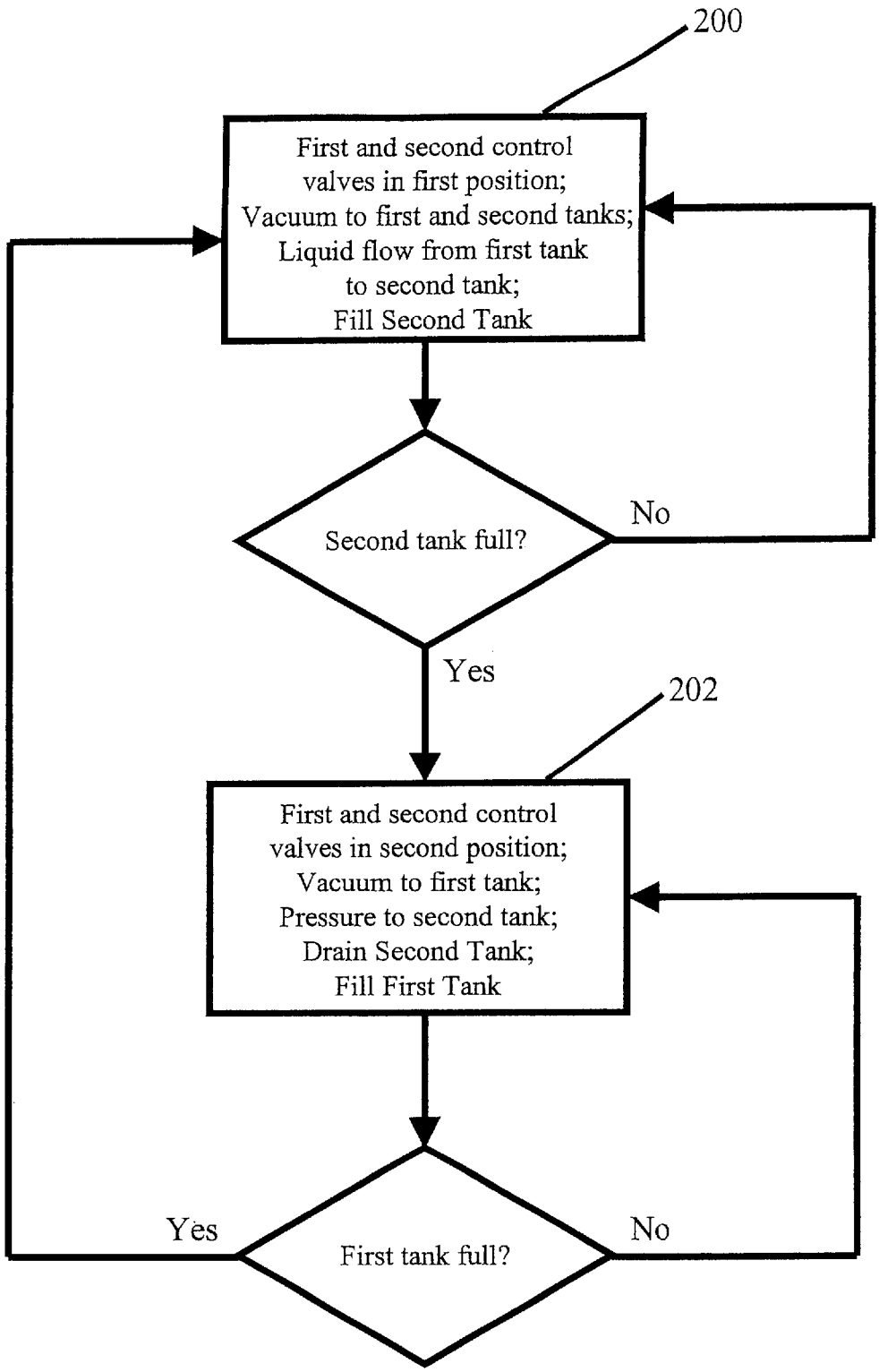
FIG. 3 is a flow chart illustrating operating steps using the first embodiment of the present invention; and, FIG. 4 is a flow chart illustrating operating steps using the second embodiment of the present invention.

A controller 38 is provided to control operation of the first and second control valves 16, 18 in response to the volume of liquid in each of the first and second liquid storage tanks 10, 12 as sensed by the first and second float-type switches 10*b*, 12*a*. The system of the present invention is intended for use as part of a manufacturing process wherein, following starting of the engines, the oil and gasoline therein must be evacuated to facilitate subsequent handling and shipment of the engine. In that light, and keeping in mind that the oil and gasoline evacuation systems are maintained separately, operation of the system will be described hereinafter with reference to the flow chart of FIG. 3 and the foregoing description of the system.

The description of the operation of the system presumes an initial condition wherein the first control valve 16 is in the first position establishing communication between the first and second liquid storage tanks 10, 12 and the second control valve 18 is in the first position establishing communication between the vacuum source 22 and the second liquid storage tank 12. As such, under-atmospheric pressure is provided to the first and second liquid storage tanks 10, 12. When an engine to be evacuated is brought to the system, the inlet nozzle 24*b* is inserted into the engine reservoir (i.e., crankcase or fuel tank) and the inlet nozzle valve is opened to draw the liquid through the first conduit 24 and into the first liquid storage tank 10. The liquid subsequently flows, at least partly due to gravity, through the second conduit 26 and first control valve 16 and into the second liquid storage tank 12, and begins filling the second liquid storage tank 12 (step 200).

This continues until, after a number of engine reservoirs are emptied, the second liquid storage tank 12 fills to the point that the second float-type switch 12*a* is actuated. This causes the controller 38 to move the first and second control valves 16, 18 from their first position to their second position. Moving the first control valve 16 to it's second position blocks communication between the first and second liquid storage tanks 10, 12. Placing the second control valve 18 in its second position places the pressure source 20 in communication with the second liquid storage tank 12, and thereby establishes an over-atmospheric pressure in the second liquid storage tank 12. The pressure thus established above the liquid in the second storage tank 12 forces the liquid in the second storage tank 12 to flow through outlet conduit 36 and into the return tank 14, emptying the second storage tank 12 (step 202).

While the second storage tank 12 is being emptied, under-atmospheric pressure is still communicated to the first liquid storage tank 10, and the system continues to be used for evacuating engine reservoirs. Since the first control valve 16 is closed, the liquid evacuated from the engine reservoirs is retained in the first liquid storage tank 10. After a number of engine reservoirs are emptied, the first float-type switch 10*b* is actuated, causing the controller 38 to move the first and second control valves 16, 18 from their second positions back to their first positions. Moving the second control valve 18 to the first position removes pressure from the second liquid storage tank 12, and communicates under-atmospheric pressure or vacuum to the second liquid storage tank 12. Moving the first control valve 16 to the first position reestablishes fluid communication between the first and second liquid storage tanks 10, 12, and therefore permits liquid to again flow through the second conduit 26 and first control valve 16 (from the first liquid storage tank 10 to the second liquid storage tank 12; return to step 200).

Naturally, it is contemplated that a vent may be provided such that the second liquid storage tank 12 will be briefly vented to atmosphere when switched from the pressure source 20 to the vacuum source 22. Moreover, it is contemplated that a brief time delay may be provided by the controller 38 wherein the second control valve 18 may return to it's first position shortly before the first control valve 16 returns to it's first position.

Following return of the control valves 16, 18 to their first positions, the second liquid storage tank 12 fills with liquid previously contained in the first liquid storage tank 10, as well as liquid added to the system from subsequently evacuated engine reservoirs. The system thus continues filling the second liquid storage tank 12 and then, while draining the second liquid storage tank 12 into the return tank 14, filling the first liquid storage tank 10. As will be apparent to those skilled in the art, the available volumes of the first and second liquid storage tanks 10, 12 (i.e., the volumes available before the associated float-type limit switches 10*b*, 12*a* are actuated) may be selected within wide limits and, for example, can be selected or tuned to the expected throughput of the system based upon the available space for the first and second liquid storage tanks 10, 12 in the manufacturing environment. Preferably, the tank sizes are selected such that, considering normal operating cycles, the second liquid storage tank 12 is completely emptied before the first liquid storage tank 10 is filled, and such that the available volume of the first liquid storage tank 10 may be completely received within the available volume of the second liquid storage tank 12.

Figure 2:
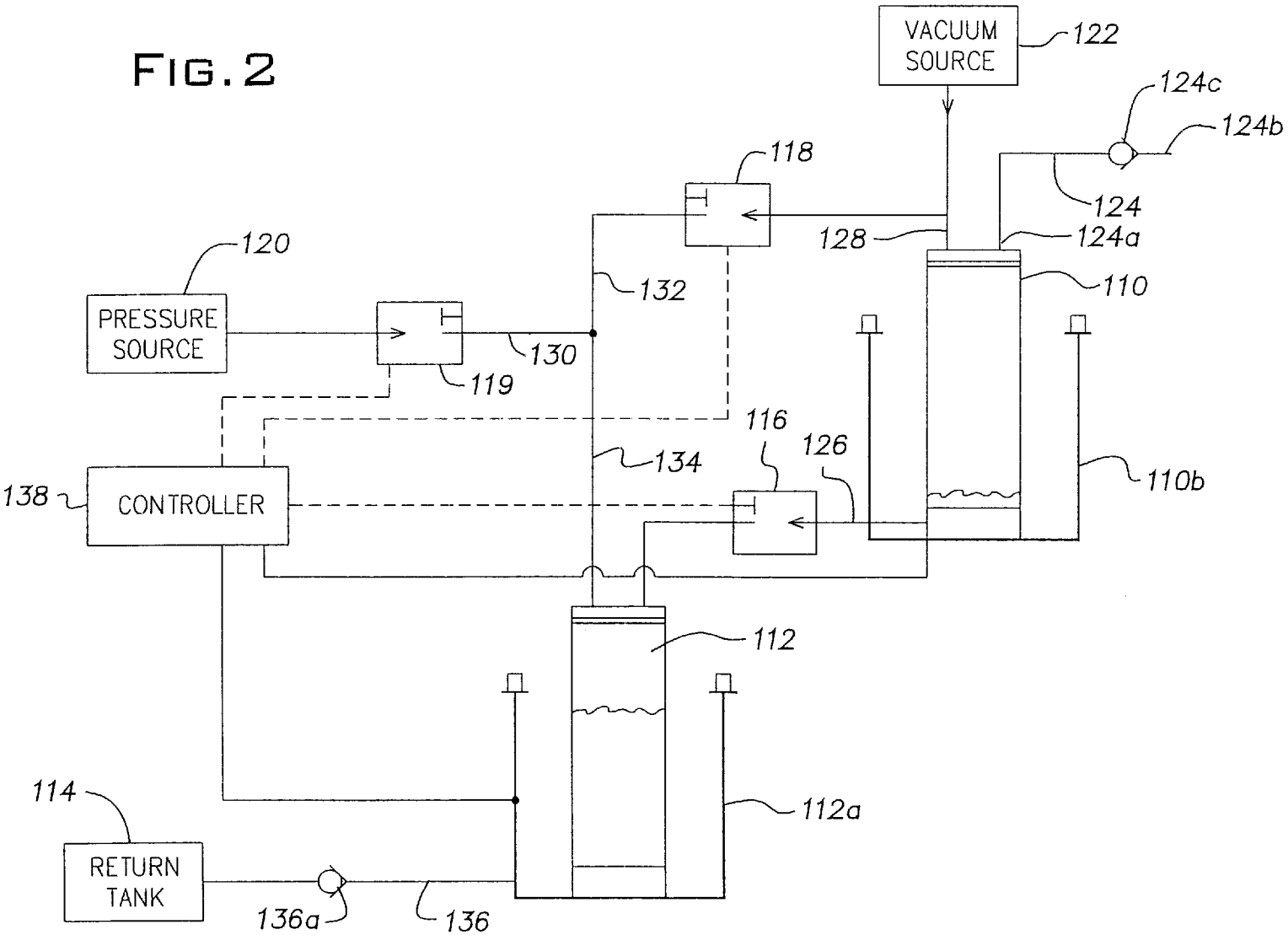
FIG. 2 is a schematic diagram of a system according to a second preferred embodiment of the present invention.

With reference to FIG. 2, a second preferred embodiment of the present invention is illustrated. The second preferred embodiment differs from the first embodiment described hereinbefore by providing dedicated control valves for controlling communication of vacuum or sub-atmospheric pressure and pressurized or over-atmospheric pressure air to the second liquid storage tank, as will be apparent from the following description.

The system according to the second embodiment includes a first liquid storage tank 110, a second liquid storage tank 112, a return tank 114, a first control valve 116, a second control valve 118, a third control valve 119, a pressure source 120, a vacuum source 122, and a series of conduits 124, 126, 128, 130, 132, 134.

The first liquid storage tank 110 is connected to an outlet 124*a* of a first conduit 124, which serves as a liquid inlet and includes an inlet nozzle 124*b* having an inlet nozzle valve (not shown). The first conduit 124 has a check valve 124*c* disposed therein to prevent reverse flow therethrough. The inlet nozzle 124*b* is designed for insertion into an engine reservoir, such as a crankcase or fuel tank, and the nozzle valve is opened and closed by a user to permit communication of suction to the inlet nozzle 124*b* and thereby withdraw liquids from the engine reservoir. Liquids flowing through the inlet conduit 124 are delivered to the first liquid storage tank 110.

The first liquid storage tank 110 is fluidly connected to the second liquid storage tank 112 via a second conduit 126 and is connected to the vacuum source 122 via a first vacuum conduit 128. Preferably, the second conduit 126 is connected at one end to a bottom of the first liquid storage tank 110 and, at the other end, to the top of the second liquid storage tank 112, as illustrated. The second conduit 126 has a first control valve 116 disposed therein to control liquid flow through the second conduit 126 from the first liquid storage tank 110 toward the second storage tank 112. The first control valve 116 is movable between a first position establishing fluid communication between the first and second liquid storage tanks 110, 112 and a second position blocking fluid communication between the storage tanks 110, 112.

The first vacuum conduit 128 is connected to a top of the first liquid storage tank 110. A first liquid level sensor 110*b* is associated with the first liquid storage tank 110 and serves to sense the level of liquid therein. In this embodiment the sensor is preferably a scale-type sensor that monitors the weight of the first liquid storage tank 110. Such a sensor arrangement may be more reliable, over time, in challenging environments. Naturally, it is considered apparent that means other than the illustrated and preferred sensor may be used with equal functionality without departing from the scope and spirit of the present invention.

The second liquid storage tank 112 is disposed vertically below the first liquid storage tank 110 and receives liquids from the first liquid storage tank 110 by means of the second conduit 126 and the first control valve 116. The second liquid storage tank 112 is also connected to the return tank 114 by means of an outlet conduit 136 that extends from a bottom of the tank 112. Preferably, a check valve 136*a* is disposed in the outlet conduit 136, as illustrated, to prevent reverse flow of liquid in the outlet conduit 136.

The second liquid storage tank 112 is also connected to the vacuum source 122 and to the pressure source 120. More specifically, and as illustrated in FIG. 2, the vacuum source 122 is connected to the second liquid storage tank 112 by means of the second control valve 118, a second vacuum conduit 132, and a common conduit 134 while the pressure source 120 is connected to the second liquid storage tank 112 by means of the third control valve 119, a pressure conduit 130, and the common conduit 134.

The second and third control valves 118, 119 are dedicated to controlling communication from the pressure and vacuum sources 120, 122, respectively. However, as will be appreciated from the following description, the second and third control valves 118, 119 are operated by the controller 138 in a synchronous fashion. As such, the second control valve 118 is movable between a first position wherein the vacuum source 122 is in communication with the second liquid storage tank 112 and a second position wherein the vacuum source 122 is not in communication with the second tank. Similarly, the third control valve 119 is movable between a first position wherein communication of pressurized air from the pressure source 120 to the second liquid storage tank 112 is prevented and a second position wherein the pressure is communicated to the second liquid storage tank 112. When the second control valve 118 is in it's first position the third valve 119 is in it's first position and, when the second control valve 118 is in it's second position the third valve 119 is in it's second position.

The second liquid storage tank 112 also has a scale-type sensor/transducer 112*a* wherein the level of liquid in the tank is correlated to the weight of the tank. As noted hereinbefore, it is considered apparent that means other than the scale-type sensor 112*a* may be used with equal functionality without departing from the scope and spirit of the present invention.

Figure 4:
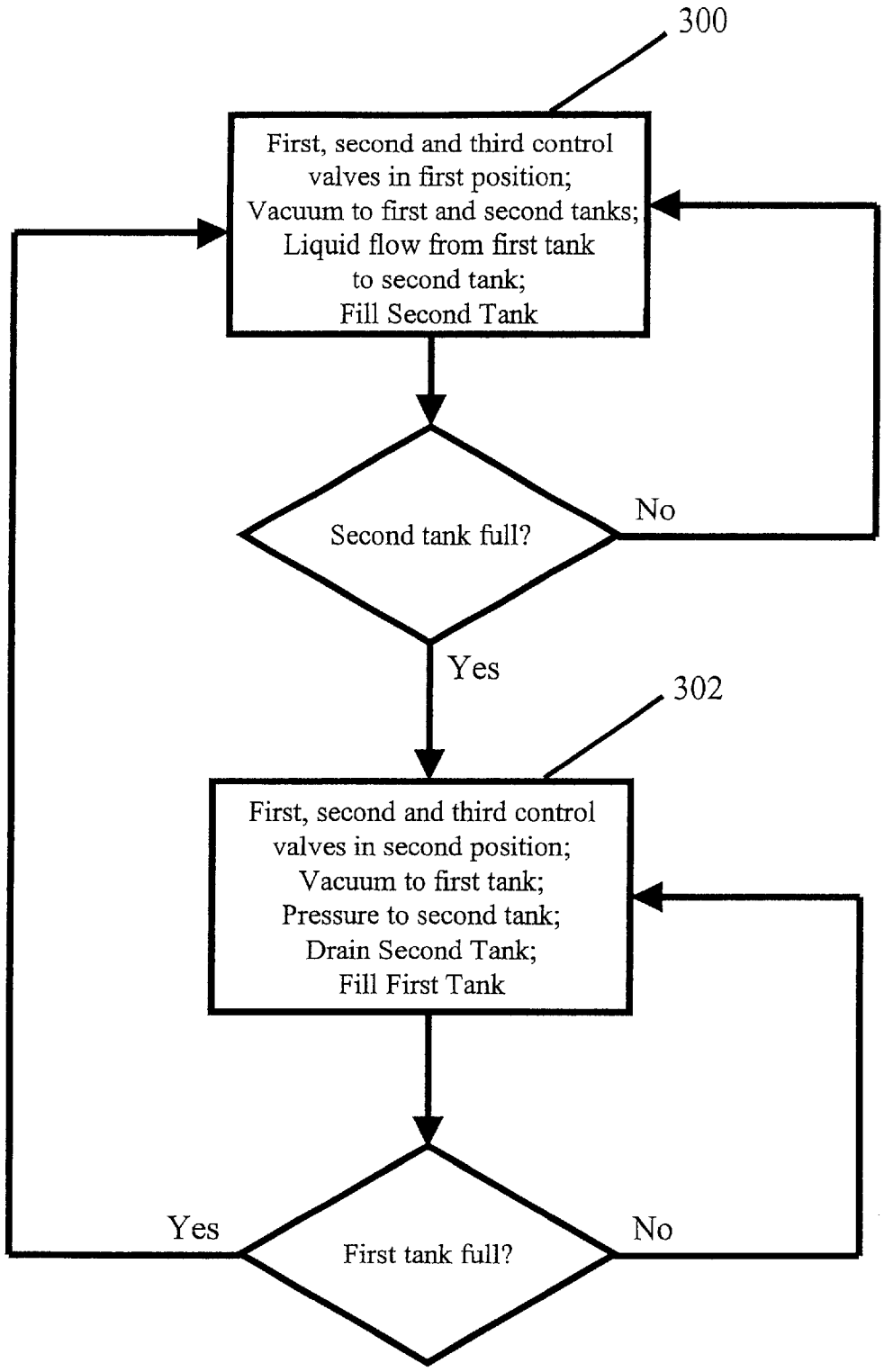

A controller 138 is provided to control operation of the first, second, and third control valves 116, 118, 119 in response to the volume of liquid in each of the first and second liquid storage tanks 110, 112 as sensed by the sensors 110*b*, 112*a*. Operation of the system will be described hereinafter with reference to the flow chart of FIG. 4 and the foregoing description of the system.

The description of the operation of the system presumes an initial condition wherein the first control valve 116 is in the first position establishing communication between the first and second liquid storage tanks 110, 112, the second control valve 118 is in the first position establishing communication between the vacuum source 122 and the second liquid storage tank 112, and the third control valve 119 is in the first position preventing communication between the pressure source 120 and the second liquid storage tank 112. As such, under-atmospheric pressure is provided to the first and second liquid storage tanks 110, 112. When an engine to be evacuated is brought to the system, the inlet nozzle 124*b* is inserted into the engine reservoir (i.e., crankcase or fuel tank) and the inlet nozzle valve is opened to draw the liquid through the first conduit 124 and into the first liquid storage tank 110. The liquid subsequently flows, at least partly due to gravity, through the second conduit 126 and first control valve 116 and into the second liquid storage tank 112, and begins filling the second liquid storage tank 112 (step 300).

After a number of engine reservoirs are emptied in the aforementioned manner, the second liquid storage tank 112 fills to the point that the scale-type sensor/transducer 112*a* is actuated, indicative of a predetermined volume/weight of liquid in the second tank 112. The controller 138 actuates the first, second, and third control valves 116, 118, 119 to move from their first positions to their second positions. Moving the first control valve 116 to it's second position blocks fluid communication between the first and second liquid storage tanks 110, 112. Placing the second control valve 118 in its second position disconnects the vacuum source 122 from the second liquid storage tank. Moving the third control valve 119 to the second position places the pressure source 120 in communication with the second liquid storage tank 112, and thereby establishes an over-atmospheric pressure in the second liquid storage tank. 112. The pressure thus established above the liquid in the second storage tank 112 forces the liquid in the second storage tank 112 to flow through outlet conduit 136 and into the return tank 114, emptying the second storage tank 112 (step 302).

While the second storage tank 112 is being emptied, under-atmospheric pressure is still communicated to the first liquid storage tank 110, and the system continues to be used for evacuating engine reservoirs. Since the first control valve 116 is closed, the liquid evacuated from the engine reservoirs is retained in the first liquid storage tank 110. After a number of engine reservoirs are emptied, the first scale-type sensor/transducer 110*b* is actuated, indicative of a predetermined volume/weight of liquid in the first tank, and thereby causes the controller 138 to move the first, second, and third control valves 116, 118, 119 from their second positions back to their first positions. Moving the third control valve 119 to the first position disconnects pressure from the second liquid storage tank 112, while moving the second control valve 118 to the first position communicates under-atmospheric pressure or vacuum from the vacuum source 122 to the second liquid storage tank 112. Moving the first control valve 116 to the first position re-establishes fluid communication between the first and second liquid storage tanks 110, 112, and therefore permits liquid to again flow through the second conduit 126 and first control valve 116 (from the first liquid storage tank 110 to the second liquid storage tank 112; return to step 300).

As with the first embodiment, it is contemplated that a vent may be provided such that the second liquid storage tank 112 will be briefly vented to atmosphere when switched from the pressure source 120 to the vacuum source 122. Moreover, it is contemplated that a brief time delay may be provided by the controller 138 wherein the second control valve 118 may return to it's first position shortly before the first control valve 116 returns to it's first position.

Following return of the control valves 116, 118 to their first positions, the second liquid storage tank 112 fills with liquid previously contained in the first liquid storage tank 110, as well as liquid added to the system from subsequently evacuated engine reservoirs. The system thus continues filling the second liquid storage tank 112 and then, while draining the second liquid storage tank 112 into the return tank 114, filling the first liquid storage tank 110. As will be apparent to those skilled in the art, the available volumes of the first and second liquid storage tanks 110, 112 (i.e., the volumes available before the associated float-type limit switches 110*b*, 112*a* are actuated) may be selected within wide limits and, for example, can be selected or tuned to the expected throughput of the system based upon the available space for the first and second liquid storage tanks 110, 112 in the manufacturing environment. Preferably, the tank sizes are selected such that, considering normal operating cycles, the second liquid storage tank 112 is completely emptied before the first liquid storage tank 110 is filled, and such that the available volume of the first liquid storage tank 110 may be completely received within the available volume of the second liquid storage tank 112.

Moreover, although actuation of the control valves 116, 118, 119 by the controller 138 has been described hereinbefore as being in response to both the first and second scale-type sensors/transducers 110*b*, 112*a*, it is contemplated that it could instead be in response to only the second sensor 112*a*, and the first sensor 110*b* could be provided as a fail-safe to prevent overflow of the first liquid storage vessel 110.

The present invention has been described herein with particularity, but it is noted that the scope of the invention is not limited thereto. Rather, the present invention is considered to be possible of numerous modifications, alterations, and combinations of parts and, therefore, is only defined by the claims appended hereto. For example, it is contemplated that, with reference to the first embodiment, instead of using the first float-type switch to control the valves, a third float-type switch may be provided in the second liquid storage tank to sense absence of liquid in the second tank, which is indicative of the second tank's availability to receive liquid from the first liquid storage tank. In this case, the first float-type switch would be used as a system shutdown upon threatened overflow of the first liquid storage tank, as may occur during a problem in draining of the second tank or malfunction of the third float-type switch.

What is claimed is:

1. A system for removing liquid from an engine, said system comprising:

a first conduit adapted for insertion into an engine reservoir that contains liquid to be removed;

a first liquid storage tank for receiving liquid from said first conduit;

a second liquid storage tank adapted to receive liquid from said first liquid storage tank via a second conduit, said second liquid storage tank being vertically below said first liquid storage tank;

a first control valve disposed in said second conduit between said first and second liquid storage tanks, said first control valve being operable to control fluid communication between said first and second liquid storage tanks;

a vacuum source for establishing sub-atmospheric pressure in said first and second liquid storage tanks;

a pressurized air source that selectively communicates pressurized air to said second liquid storage tank;

a return tank that receives liquid from said second liquid storage tank;

a second control valve for controlling communication between said vacuum source and said second liquid storage tank;

sensors for sensing liquid levels in said first and second liquid storage tanks; and, a controller for actuating said first and second control valves, and for controlling communication of pressurized air to said second liquid storage tank, in response to said sensed liquid levels.

2. The system for removing liquid according to claim 1, wherein said second control valve also controls communication between said pressure source and said second liquid storage tank.

3. The system for removing liquid according to claim 1, further comprising a third valve that is operable to control communication between said pressure source and said second liquid storage tank.

4. The system for removing liquid according to claim 2, wherein said vacuum source is continuously connected to said first liquid storage tank.

5. The system for removing liquid according to claim 3, wherein said vacuum source is continuously connected to said first liquid storage tank.

6. The system for removing liquid according to claim 1, wherein said first conduit includes a nozzle valve by means of which a user manually opens and closes the first conduit.

7. The system for removing liquid according to claim 1, further comprising vent means whereby the second liquid storage tank may be vented to atmosphere when switching between sub-atmospheric and over-atmospheric pressures.

8. The system for removing liquid according to claim 7, wherein said second control valve also controls communication between said pressure source and said second liquid storage tank, and wherein, when said pressure source is in communication with said second liquid storage tank, liquid is forced from said second liquid storage tank and into said return tank.

9. The system for removing liquid according to claim 7, further comprising a third valve that is operable to control communication between said pressure source and said second liquid storage tank, and wherein, when said pressure source is in communication with said second liquid storage tank, liquid is forced from said second liquid storage tank and into said return tank.

10. A method for removing liquid from an engine reservoir, comprising the steps of:

providing a first liquid storage tank, a second liquid storage tank disposed vertically below said first liquid storage tank, a first conduit providing selective communication between the engine reservoir and the first liquid storage tank, a second conduit providing selective fluid communication between said first and second liquid storage tanks, a third conduit providing fluid communication from said second liquid storage tank to a return tank, and a first control valve disposed in said first conduit and being operable, when in a first position, to permit communication of liquid from said first liquid storage tank to said second liquid storage tank and, when in a second position, to prevent communication between said first and second liquid storage tanks;

communicating sub-atmospheric pressure air to said first and second liquid storage tanks, inserting a nozzle of said first conduit into the engine reservoir, said first conduit including a nozzle valve for controlling communication of liquid from said engine reservoir to said first liquid storage tank via said first conduit;

placing said first control valve in the first position to permit liquid to flow from said first liquid storage tank to said second liquid storage tank;

monitoring a level of liquid in said first and second liquid storage tanks;

when said liquid level in said second liquid storage tank reaches a first predetermined level, performing the steps of:

placing said first control valve in the second position to prevent liquid flow from said first liquid storage tank to said second liquid storage tank; and, discontinuing communication of sub-atmospheric pressure air to said second liquid storage tank and communicating over-atmospheric pressure air to said second liquid storage tank to force liquid therein to flow through said third conduit toward said return tank;

when said liquid level in one of said first and second liquid storage tanks reaches a second predetermined level, performing the steps of:

discontinuing communication of over-atmospheric pressure air to said second liquid storage tank and reestablishing communication of sub-atmospheric pressure air to said second liquid storage tank; and, returning said first control valve to the first position to permit liquid to flow from said first liquid storage tank to said second liquid storage tank.

11. The method according to claim 10, wherein said second predetermined liquid level is a relatively high level in said first liquid storage tank.

12. The method according to claim 10, wherein said second predetermined liquid level is a relatively low level in said second liquid storage tank.

13. The method according to claim 10, comprising the further steps of:

providing a second control valve that is movable between a first position communicating sub-atmospheric pressure to said second liquid storage tank and a second position communicating over-atmospheric pressure to said second liquid storage tank.

14. The method according to claim 13, wherein said second predetermined liquid level is a relatively high level in said first liquid storage tank.

15. The method according to claim 13, wherein said second predetermined liquid level is a relatively low level in said second liquid storage tank.

16. The method according to claim 10, comprising the further steps of:

providing a second control valve and a third valve, said second control valve controlling communication of sub-atmospheric pressure air to said second liquid storage tank and said third valve controlling communication of over-atmospheric pressure air to said second liquid storage tank.

17. The method according to claim 16, wherein said second predetermined liquid level is a relatively high level in said first liquid storage tank.

18. The method according to claim 16, wherein said second predetermined liquid level is a relatively low level in said second liquid storage tank.

19. The method according to claim 10, further comprising the step of venting said second liquid storage tank to atmosphere when switching between sub-atmospheric and over-atmospheric pressures.

* * * * *